US005318228A

United States Patent [19]

Macas

[11] Patent Number: 5,318,228

[45] Date of Patent: Jun. 7, 1994

[54] SODIUM DISPERSION AND ORGANOHALIDE REACTION PROCESSES

[75] Inventor: Tadas S. Macas, Pennington, N.J.

[73] Assignee: Neos Technology Inc., West Vancouver, Canada

[21] Appl. No.: 990,748

[22] Filed: Dec. 15, 1992

[51] Int. Cl.[5] ..... B02C 17/24

[52] U.S. Cl. ..... 241/21; 241/30

[58] Field of Search ..... 241/1, 21, 30, 170, 241/171, 172

[56] References Cited

U.S. PATENT DOCUMENTS

| | | | |
|---|---|---|---|
| 2,758,096 | 8/1956 | Hill . | |
| 3,012,974 | 12/1961 | Robinson et al. . | |
| 3,677,477 | 7/1972 | Watson et al. | 241/31 |
| 3,852,315 | 12/1974 | De Groot et al. | 554/169 |
| 4,132,666 | 1/1979 | Chikatsu et al. | 366/249 X |
| 4,150,244 | 4/1979 | Knorre et al. | 568/851 |
| 4,284,516 | 8/1981 | Parker et al. | 210/757 |
| 4,348,300 | 9/1982 | McCartney et al. | 252/309 |
| 4,678,614 | 7/1987 | Kamienski et al. | 260/665 R |
| 5,005,773 | 4/1991 | Nyberg et al. | 241/30 |
| 5,041,089 | 4/1991 | Vock et al. | 241/30 X |

FOREIGN PATENT DOCUMENTS

| | | | |
|---|---|---|---|
| 1142551 | 3/1983 | Canada | 242/30 |
| 458333 | 7/1975 | U.S.S.R. | 241/30 |
| 1119729 | 10/1984 | U.S.S.R. | 241/1 |

*Primary Examiner*—Mark Rosenbaum
*Assistant Examiner*—Frances Chin
*Attorney, Agent, or Firm*—Norman M. Cameron

[57] ABSTRACT

A process for the production of an alkali dispersion includes charging a mixing vessel with a solid alkali metal, a liquid which is inert to the alkali metal and a grinding media. The vessel is connected to a vibrating driver which is vibrated until the alkali metal is ground by the media finely enough to form a dispersion in the liquid. Preferably the driver is a resonant driver which is vibrated at the resonant frequency of the driver. Mineral oils or other liquids containing organohalides such as PCBs can be used as a liquid which is treated during the grinding by the organohalide reacting with the alkali metal.

27 Claims, 1 Drawing Sheet

SODIUM DISPERSION AND ORGANOHALIDE REACTION PROCESSES

BACKGROUND OF THE INVENTION

1. Field of the Invention

This invention relates to processes for making dispersions of alkali metals, particularly sodium, and for treating organohalides such as PCBs.

2. Description of Related Art

Various methods have been developed for making finely divided dispersions of alkali metals in an inert liquid. Such dispersions are typically prepared for chemical processes in which the alkali metal is used as a reactant. The concentration of alkali metals in such dispersions varies from trace quantities up to sixty percent. The particle size of the sodium in the dispersion typically varies from a few millimeters down to submicron dimensions. Typically the particles are in the range of 1 to 30 microns.

Three methods have been widely adopted for preparing sodium dispersions: (1) The high speed stiring method; (2) The colloid mill process; and (3) The pump or jet method.

All three prior art methods involve significant disadvantages. For example, the high speed stirring method is time consuming and is limited to batch operations. Furthermore, this method involves the use of an external stirring motor apparat which requires a mechanical seal or packing gland to connect the shaft of the stirrer into the stirring vessel. This necessary feature requires special cooling designs since water-based coolant must be avoided. Mechanical wear of the gland leads to the emission of gas and liquid leaks. Admission of atmospheric air into the reactor during preparation of the dispersion presents a hazard owing to the reactive nature of the finely dispersed sodium. the relatively long processing time requires large batch operations. Such a large inventory of hazardous materials creates major safety concerns.

The colloid mill method requires preparation and handling of hot, molten sodium. A considerable amount of heating is needed due to the large specific heat of sodium. The process is time consuming and also involves the use of mechanical stirrers and colloid mills which require packing glands or mechanical seals to connect the drive motor to an internal stirring shaft for the mixer or rotor for the colloid mill. The high speed of the rotor presents special difficulties with respect to cooling of the gland as well as mechanical wear of the gland parts. Also, special colloid mills are required for the purpose.

The pump jet method suffers most of the disadvantages of the colloid mill process. These include the handling of molten sodium, high temperature dispersion, intolerance of solid impurities and mechanical scaling of the drive motor to the pump to exclude atmospheric air.

The prior art also includes a number of processes and apparatuses intended to cause reactions with organohalides, such as polychlorinated biphenyl compounds (PCBs). These compounds have been widely used in the past because of their surprising chemical and thermal stability. They are formed by the chlorination of aromatic biphenyls. Typically they are used for their electrical insulating, fire-resistant and heat-transfer properties and as hydraulic fluids. As an electrical insulating liquid, PCBs have been used in transformers, capacitors, cables and circuit breakers, usually admixed with other insulating liquids, such as mineral oils.

In recent years however considerable concern has arisen with respect to bioaccumulative and toxic properties exhibited by these difficult-to-destroy compounds. Attempts to destroy them have typically been directed to processes that incinerate the materials at high temperatures.

Alternatively, PCBs can be destroyed by treatment with extremely reactive metals, such as the alkali metals: lithium, sodium or potassium. For example, Canadian Patent No. 1,142,551 to Arato et al. discloses a process for treating a chlorinated biphenyl compound which comprises reacting the compound with an alkali metal or a mixture of alkali metals or an alkali metal amalgam. The liquid containing the PCBs is mixed with sodium metal in the form of fine sand, heated to a temperature in excess of 130° C. and stirred vigorously for two to four hours. The dispersed sodium reacts with the chlorine substituents on the biphenyl nucleus. The metalated PCBs are either degraded or destroyed, leaving a dark sludge that settles upon standing. The mineral oil carrier fluid for the PCBs is left sufficiently pure to allow it to be re-used.

However, this method suffers from several deficiencies. First, the liquid must be mixed with the alkali metal at a temperature above the melting point of the particular alkali metal used. This is 62° C. for potassium and 97.5° C. for sodium. Furthermore, the treatment times extend to several hours. Furthermore, sodium is usually used because it is far less expensive than potassium. In order to present a high surface area, sodium sand is preferred, but this is relatively expensive.

It is an object of the invention to produce a dispersion of an alkali metal, such as sodium, under improved production conditions and is capable of being adapted as a continuous process.

It is another object of the invention to provide a process for producing dispersions of alkali metals at lower temperatures than those of the current production methods.

It is a further object of the invention to provide a process for producing dispersions of alkali metals that is tolerant of solid impurities without requiring the filtering of hot, molten alkali metals.

It is also an object of the invention to provide a process for destroying PCBs which is capable of utilizing less expensive forms of alkali metals than sodium sand.

It is a further object of the invention to provide a process for destruction of PCBs which can be carried out at a relatively low temperature.

It is a further object of the invention to provide a method for destroying PCBs with alkali metals which is faster than previous methods using alkali metals.

It is a still further object of the invention to provide a process for destroying PCBs with alkali metals which is capable of being adapted as a continuous process instead of being restricted to a batch process.

It is a still further object of the invention to provide a more cost effective process for the reactions between alkali metals and organohalides.

SUMMARY OF THE INVENTION

In accordance with these objects a first aspect of the invention provides a process for producing an alkali metal dispersion. The process includes charging a vessel with an alkali metal, a liquid which is inert to the alkali metal, and a grinding media. The vessel is connected to a vibratory driver. The driver is then vibrated until the alkali metal is ground by the media finely enough to form a dispersion in the liquid.

Preferably a resonant driver is used which is vibrated near a resonant frequency of the driver.

A second aspect of the invention provides a process for treating an organohalide. A mixing vessel is charged with an alkali metal, a liquid which is inert to the alkali metal, the organohalide and a grinding media. The vessel is connected to a vibratory driver and vibrated so the sodium is ground by the media and reacts with the organohalide.

BRIEF DESCRIPTION OF THE DRAWING

The drawing is a partial sectional side view of a sonic generator of the type used for the processes according to the invention.

DESCRIPTION OF THE PREFERRED EMBODIMENT

Figure 1:
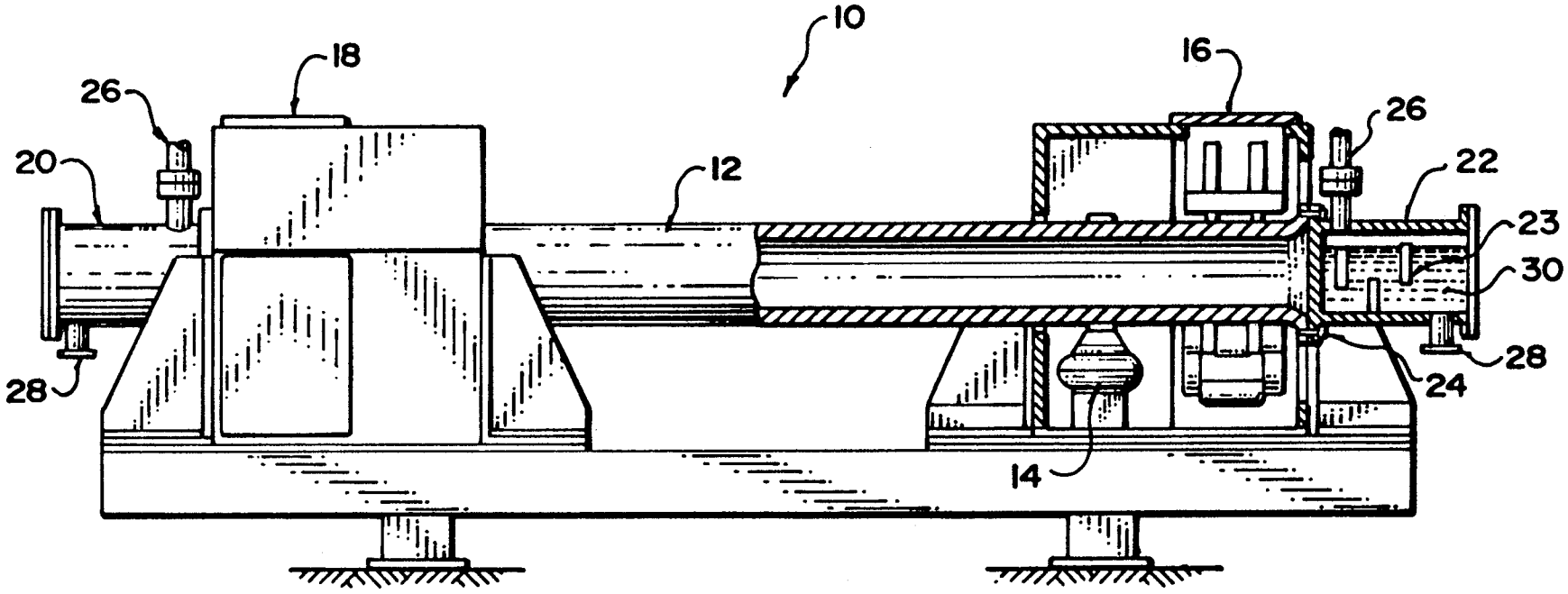

The sonic generator 10 shown in the drawings is generally the same as disclosed and claimed in the U.S. Pat. No. 5,005,773 to Nyberg, although other apparatuses for vibrating containers could be substituted. The sonic generator 10 has a resonant member 12 in the form of an elongated bar. The member 12 is supported on nodal locations by air bags 14. Electromagnetic drive units 16 and 18 are connected to the resonant member 12, preferably at the anti-nodes. The drive units are excited at the resonant frequency of the member 12.

Grinding vessels 20 and 22 are connected to opposite ends of the member, preferably at the anti-nodes, by bolts 24. The vessels have internal baffles 23 in this preferred embodiment as shown for vessel 22.

Conduits 26 are connected to the tops of the vessels for filling the vessels and conduits 28 are connected to the bottoms of the vessels for emptying them. Conduits 26 are used for filling the vessels with material 30 to be ground as shown in the interior of vessel 22.

The member 12 is supported at the nodal points by the air bags so it is substantially unrestrained. The vessels 20 and 22 are rigidly and removably mounted to the ends of the member.

A first aspect of the invention involves a process for making dispersions of sodium and other alkali metals utilizing a vibratory grinder, such as sonic generator 10. The vessels 20 and 22 are charged with a mixture of an alkali metal, such as sodium or potassium, a liquid which is inert to the alkali metal and a grinding media. Optionally a dispersing agent may also be added.

The alkali metal is added in solid form, typically in particulate form having particles ranging in size from 0.5 to 2.5 cm. The particles need not be spherical, irregular shapes being satisfactory. It is advantageous to use an alkali metal that is substantially free from oxides or other impurities, but the process will work without having the impurities removed by prior filtering or the like.

The liquid used must be inert in the presence of the alkali metal so obviously aqueous solutions must be avoided. However, a wide variety of non-aqueous liquids may be utilized such as mineral oils or paraffin oils. Paraffin oils are commercially available in a range of molecular weights, boiling points and viscosity characteristics. The paraffin chosen for the process normally must have a boiling point sufficiently high to avoid ebullition during the dispersion process. Additionally the viscosity of the selected oil should be sufficiently low to allow generation of finely subdivided sodium particles in the size range of less than 50 microns. Other liquids such as toluene or xylenes, to name just two, could be utilized.

The grinding media can be selected from common materials, preferably metallic or ceramic spheres. The important thing is that the media must be inert to the chemical action of sodium metal and the suspending liquid. Spheres of hardened chrome steel alloys are preferred. The size distribution of the spherical grinding media can be adjusted to yield different rates of dispersion and alkali metal particle size. The precise election of grinding media depends upon the type of resonant driver used, the vibrating power applied, and the size, shape and internal baffles of the mixing vessels.

Dispersing agents, well known in the production of sodium dispersions in the prior art, can be readily added to the mixture charged into the vessels. The agents help to form a weak gel structure in which the solid sodium particles are suspended. The agents can also decrease the surface tension of the suspending liquid and protect the sodium agglomeration. Also, the dispersing agents aid in the production of smaller particle sizes. Dispersing agents that have been used in producing sodium dispersions include fatty acids, such as oleic acid, high molecular weight alcohols and esters, as well as solid adsorbents, such as finely divided bentonite or carbon. The dispersing agents are typically added in proportions of 0.25–3.0 percent of the total weight of the dispersion.

Once the vessels have been charged, power is supplied to the electromagnetic drive units 16 and 18 shown in the drawings so the vessels are vibrated. The operation continues until the sodium has been ground sufficiently fine to form the desired dispersion. The amount of time depends upon on many factors including the size of the initial particles, the particular alkali metal used, the particular liquid utilized, the nature of the dispersing agent, if any, and the size of the vessels.

EXAMPLE 1—PREPARATION OF SODIUM SAND

A vessel (3.25 l), was charged with sodium metal (10 g) (as an equi-mixture of slices (average thickness 1 to 2 mm) and cubes (0.6 to 1.1 cm)), paraffin oil (1.35 l), and chromo stainless steel balls (diameter 0.25 inches) (12.5 kg). The vessel was mounted to a driver (3.6 m long) of a sono-reactor as generally taught in U.S. Pat. No. 5,005,773. The vessel was vibrated for a total period of 100 seconds at a mechanical frequency of 100 Hz. The sodium was ground to a fine sodium suspension of spherical dimension of 50 micrometers and less.

ORGANOHALIDE REACTION PROCESS

The same apparatus and substantially the same methods described above can be utilized in treating organohalides such as PCBs. The main distinction is that liquids containing chlorinated aromatic compounds, such as PCB contaminated oil, are added to the vessels. Alkali metal particles, typically sodium, are added and can be much larger in size than the sand preferred for prior art processes for treating PCBs with alkali metals.

The purpose of the processes is not to form a dispersion of the alkali metal, however, so a dispersing agent is typically not employed. The grinding media may be similar to those described above and the process is continued until all of the organohalides have reacted with the alkali metal. The speed of this reaction is considerably enhanced by any or all of the grinding of the alkali metal into smaller particle sizes, the concurrent agitation of the reacting mixture by the vibrating vessels, and/or the exposure of fresh reactive surfaces on the alkali metal particles.

Once the reaction is completed, the sonic generator is shut off and the vessels can be removed if desired. They are allowed to remain stationary until the black sludge which includes the metallized organohalides settles to the bottom of the vessels together with unreacted alkali metal. After this occurs, the purified oil can be removed from the vessels. However, the oil must be decanted from the top, rather than being removed through conduits 28 shown in the drawings to avoid contaminating the purified oil with the sludge. The grinding media can be removed from the sludge for re-use by screening.

In a continuous mode, the separation of the products and grinding material can be effected using conventional continuous separation techniques, well understood by those skilled in the art. This can be carried out internally by the use of screens to retain the larger size grinding media, or external to the reaction vessels described above. In the latter case the vessels would be continuously charged with fresh reactants and/or grinding material with onward flow to the separation stage. The grinding material and unreacted alkali metal could be recycled.

EXAMPLE 2—DEHALOGENATION

A vessel (3.25 l) was charged with sodium metal (11.5 g), paraffin oil (1.20 ), chrome stainless steel balls (diameter 0.25 inches) (12.5 kg) and para-Dichlorobenzene (DCB) (14.5 g). This gave a mole ratio of DCB:Na of 1:5. The vessel was mounted to a driver (3.6 m long) of a sono-reactor as generally taught in U.S. Pat. No. 5,005,773. The vessel was vibrated for a total period of 120 seconds at a mechanical frequency of 100 Hz. At the end of the experiment the contents of the vessel were allowed to stand and a black sludge settled out. Spectral analysis (UV) of the starting and finishing oil mixture showed the disappearance of the peak at 224 nm (characteristic of DCB) in the treated mixture. From both UV and HPLC analysis of the treated mixture some 95% of the DCB was found to have been decomposed.

In a comparative test, sodium sand, prepared as in example 1, was added to an agitated flask containing paraffin oil and DCB in like ratios to the above. After 7.5 hours the same measure of DCB destruction (95%) to that found above was determined by UV and HPLC analysis.

It will be understood by someone skilled in the art that many of the details given above are by way of example only and can be changed without departing from the scope of the invention which is to be interpreted with reference to the following claims.

What is claimed is:

1. A process for producing an alkali metal dispersion, comprising the steps of:

charging a vessel with the alkali metal, a liquid which is inert to the alkali metal, and a grinding media;

connecting the vessel to a vibratory driver; and vibrating the driver until the alkali metal is ground by the media finely enough to form a dispersion in the liquid.

2. A process as claimed in claim 1, wherein the alkali metal is solid sodium.

3. A process as claimed in claim 2, wherein the sodium is particulate, having particles of 0.5 cm to 2.5 cm in width.

4. A process as claimed in claim 1, wherein the liquid is selected from the group consisting of paraffin oils, toluene, and xylenes.

5. A process as claimed in claim 1, wherein the driver is a resonant driver which is driven at its resonant frequency.

6. A process as claimed in claim 1, wherein the grinding media is metal particles.

7. A process as claimed in claim 6, wherein the particles are spherical.

8. A process as claimed in claim 7, wherein the particles are of a hardened chromesteel alloy.

9. A process as claimed in claim 1, wherein the grinding media is ceramic particles.

10. A process as claimed in claim 9, wherein the particles are spherical.

11. A process as claimed in claim 1, wherein the alkali metal is ground to a particle size of less than 50 microns.

12. A process as claimed in claim 1, wherein a dispersing agent is charged into the vessel with the alkali metal, liquid and grinding media.

13. A process as claimed in claim 12, wherein the dispersing agent forms a weak gel structure in which the sodium particles are suspended.

14. A process as claimed in claim 12, wherein the dispersing agent is selected from the group consisting of fatty acids and solid adsorbents.

15. A process as claimed in claim 14, wherein the fatty acid is selected from the group consisting of oleic acid and high molecular weight alcohols.

16. A process as claimed in claim 15, wherein the solid adsorbent is selected from the group consisting of finely divided bentonite and carbon.

17. A process as claimed in claim 12, wherein the dispersing agent is added in a proportion of 0.25% to 3% of the dispersion by weight.

18. A process as claimed in claim 1, wherein the driver has a member with a least one resonant frequency, the member being mounted at nodal points so said member is substantially unrestrained, the vessel being mounted externally of and on a free end of said member and being vibrated at a resonant frequency of said member.

19. A process as claimed in claim 18, wherein the member is electromagnetically vibrated.

20. A process for treating an organohalide comprising the steps of:

charging a vessel with reactants including an alkali metal, a liquid which is inert to the alkali metal, the organohalide, and a grinding media;

connecting the vessel to a vibratory driver; and vibrating the driver so the alkali metal is ground by the media and reacts with the organohalide.

21. A process as claimed in claim 20, wherein the driver is a resonant driver which is vibrated at the resonant frequency of the driver until substantially all of the organohalide has reacted with the alkali metal to form reaction products.

22. A process as claimed in claim 21, wherein the products reaction, unreacted alkali metal and the grinding media are allowed to settle to the bottom of the vessel after vibrating the vessel has stopped and the liquid is then separated therefrom.

23. A process as claimed in claim 21, wherein the reactants, the products and unreacted alkali metal and the grinding media are continuously removed from the vessel.

24. A process as claimed in claim 20, wherein the liquid is a mineral oil and the organohalide is PCB.

25. A process as claimed in claim 20, wherein the alkali metal is sodium, the organohalide is PCB and the sodium, liquid and PCB mixture is ground by the grinding media.

26. A process as claimed in claim 25, wherein the sodium is a particulate solid.

27. A process as claimed in claim 20, wherein the grinding media is spherical particles of steel or a ceramic.

* * * * *